US006155065A

United States Patent [19]

da Silva

[11] Patent Number: 6,155,065

[45] Date of Patent: Dec. 5, 2000

[54] EVAPORATOR COIL SUPPORT FOR A ROOM AIR CONDITIONER

[75] Inventor: Regis Batista da Silva, Sao Leopoldo, Brazil

[73] Assignee: Carrier Corporation, Syracuse, N.Y.

[21] Appl. No.: 09/367,589

[22] PCT Filed: Dec. 30, 1997

[86] PCT No.: PCT/BR97/00080

§ 371 Date: Aug. 17, 1999

§ 102(e) Date: Aug. 17, 1999

[87] PCT Pub. No.: WO99/35452

PCT Pub. Date: Jul. 15, 1999

[51] Int. Cl.[7] ..... F25D 23/12

[52] U.S. Cl. ..... 62/262; 62/298

[58] Field of Search ..... 62/262, 298

[56] References Cited

U.S. PATENT DOCUMENTS

| | | | |
|---|---|---|---|
| 4,748,827 | 6/1988 | Chang | 62/272 |
| 5,125,239 | 6/1992 | Kobayashi et al. | 62/262 |
| 5,203,400 | 4/1993 | Tsunekawa et al. | 165/59 |
| 5,467,610 | 11/1995 | Bolton et al. | 62/262 |
| 5,622,058 | 4/1997 | Ramakrishnan et al. | 62/295 |
| 5,732,565 | 3/1998 | Ramakrishnan et al. | 62/298 |
| 5,953,929 | 9/1999 | Bauman et al. | 62/259.1 |
| 6,006,534 | 12/1999 | Correa | 62/262 |

FOREIGN PATENT DOCUMENTS 60-014023 1/1985 Japan .

*Primary Examiner*—Denise L. Ferensic
*Assistant Examiner*—Mark Shulman

[57] ABSTRACT

According to the present invention, apparatus is provided for mounting an evaporator coil within an indoor section of an air conditioner. The air conditioner includes an indoor section having a housing in which an evaporator coil having a top and vertically extending tube sheets is mounted. The evaporator is supported by a horizontally extending support surface formed at the front end of the housing for supporting the lower ends of the tube sheets. First and second vertically extending evaporator support structures are disposed at each end of the horizontally extending support surface. Each of the first and second support structures are adapted to receive one of the tube sheets therein as the evaporator is displaced downwardly into engagement therewith and towards engagement with the horizontally extending support surface. A scroll structure for directing air flow through the indoor section is provided with vertically extending evaporator support channels which are in axial alignment with the vertically extending evaporator support structure in the housing. The scroll structures are adapted to be engaged with the upper ends of the tube sheets following engagement of the evaporator and tube sheets with the vertically extending evaporator support structure.

2 Claims, 7 Drawing Sheets

EVAPORATOR COIL SUPPORT FOR A ROOM AIR CONDITIONER

TECHNICAL FIELD

This invention relates generally to air conditioning systems and, more particularly, it relates to an arrangement for mounting the evaporator coil in a room air conditioner.

BACKGROUND ART

The indoor section of a room air conditioner or the indoor section of a split system air conditioner typically includes a housing which has mounted therein the evaporator coil, an indoor fan, electrical controls, and structure for directing room air to the evaporator coil and redirecting conditioned back into the space to be cooled. Designers of room air conditioners are constantly striving to increase the capacity of and efficiency of their units and at the same time reduce the size and costs of their products. The fewer the number of components, and the fewer the number of fasteners necessary to assemble those components results in a more cost effective air conditioner as a result of the decease in material and labor costs.

It is accordingly considered desirable to provide on indoor section of a room air conditioner wherein the mounting of the evaporator coil is carried with no fasteners and is supported by molded plastic components forming a part of the air conditioner housing and other support as supplied by components for directing the flow of air therethrough.

DISCLOSURE OF THE INVENTION

According to the present invention, apparatus is provided for mounting an evaporator coil within an indoor section of an air conditioner. The air conditioner includes an indoor section having a housing in which an evaporator coil having a top and vertically extending tube sheets is mounted. The evaporator is supported by a horizontally extending support surface formed at the front end of the housing for supporting the lower ends of the tube sheets. First and second vertically extending evaporator support structures are disposed at each end of the horizontally extending support surface. Each of the first and second support structures are adapted to receive one of the tube sheets therein as the evaporator is displaced downwardly into engagement therewith and towards engagement with the horizontally extending support surface. A scroll structure for directing air flow through the indoor section is provided with vertically extending evaporator support channels which are in axial alignment with the vertically extending evaporator support structure in the housing. The scroll structures are adapted to be engaged with the upper ends of the tube sheets following engagement of the evaporator and tube sheets with the vertically extending evaporator support structure.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
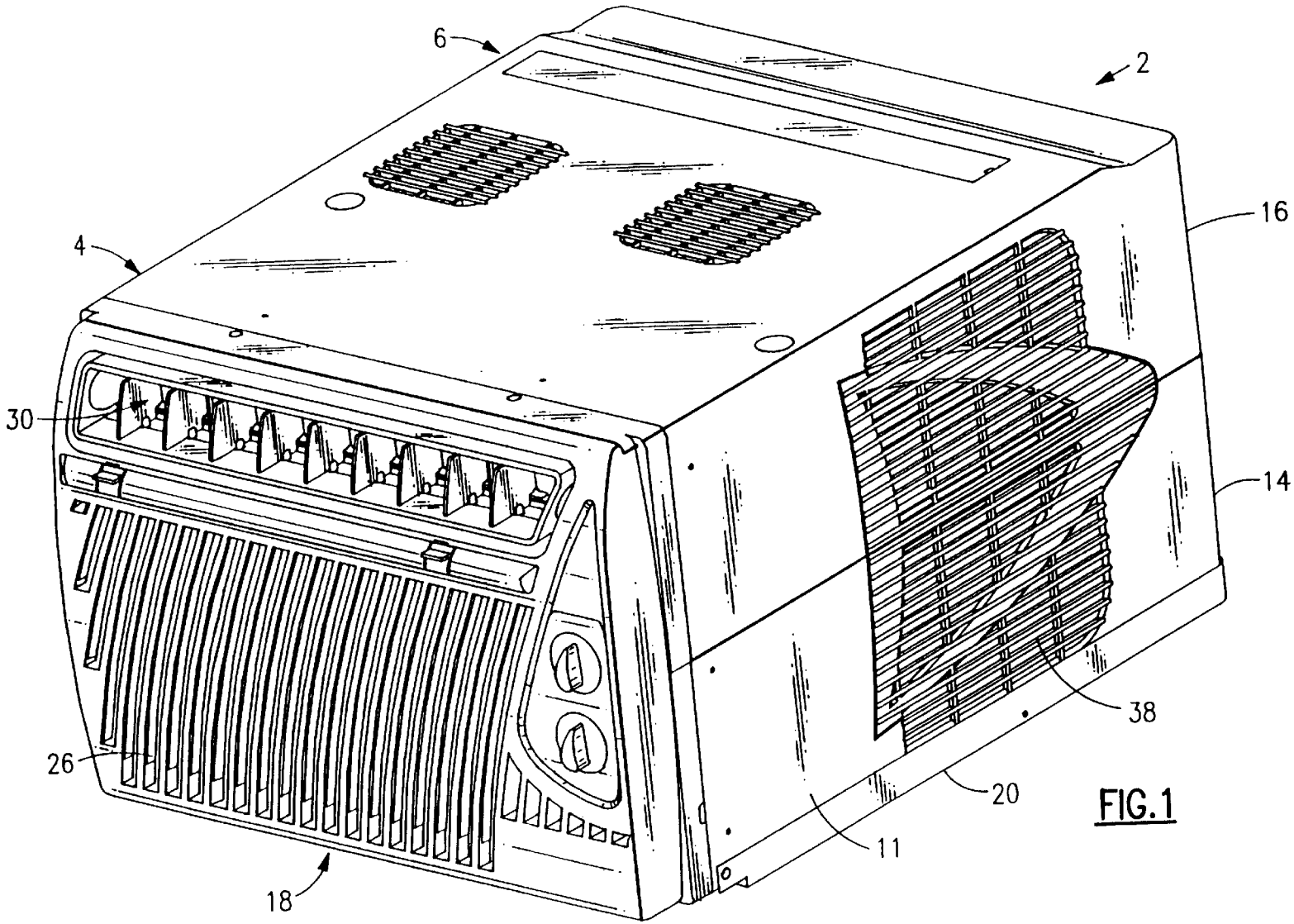
FIG. 1 is an perspective view of a room air conditioner which embodies the features of this invention.

With reference initially to FIG. 1, an air conditioner 2 includes generally an indoor section 4 and an outdoor section 6. The air conditioning unit 2, includes a substantially rectangular housing 12 which includes a lower housing section 14, an upper housing section 16, and an indoor grill section 18. The lower housing section 14 is mounted in a metal support pan 20, and the entire room air conditioner is adapted to be positioned in a rectangular opening in an exterior wall or on a windowsill in a room where cooling is desired, with the indoor grill section 18 facing into the room as is conventional.

The housing section 12 and 14 and the grill 18 are preferably made from a molded plastic material. As best seen in FIGS. 2 through 6, the entire air conditioning unit 2 is supported on a basepan 8 molded integrally with and forming the bottom of the lower housing 14. Extending upwardly from the basepan, and integrally formed with left and right sidewalls 10 and 11, respectively, is a vertically extending partition 13 which separates the indoor 4 and outdoor 6 sections.

Figure 2:
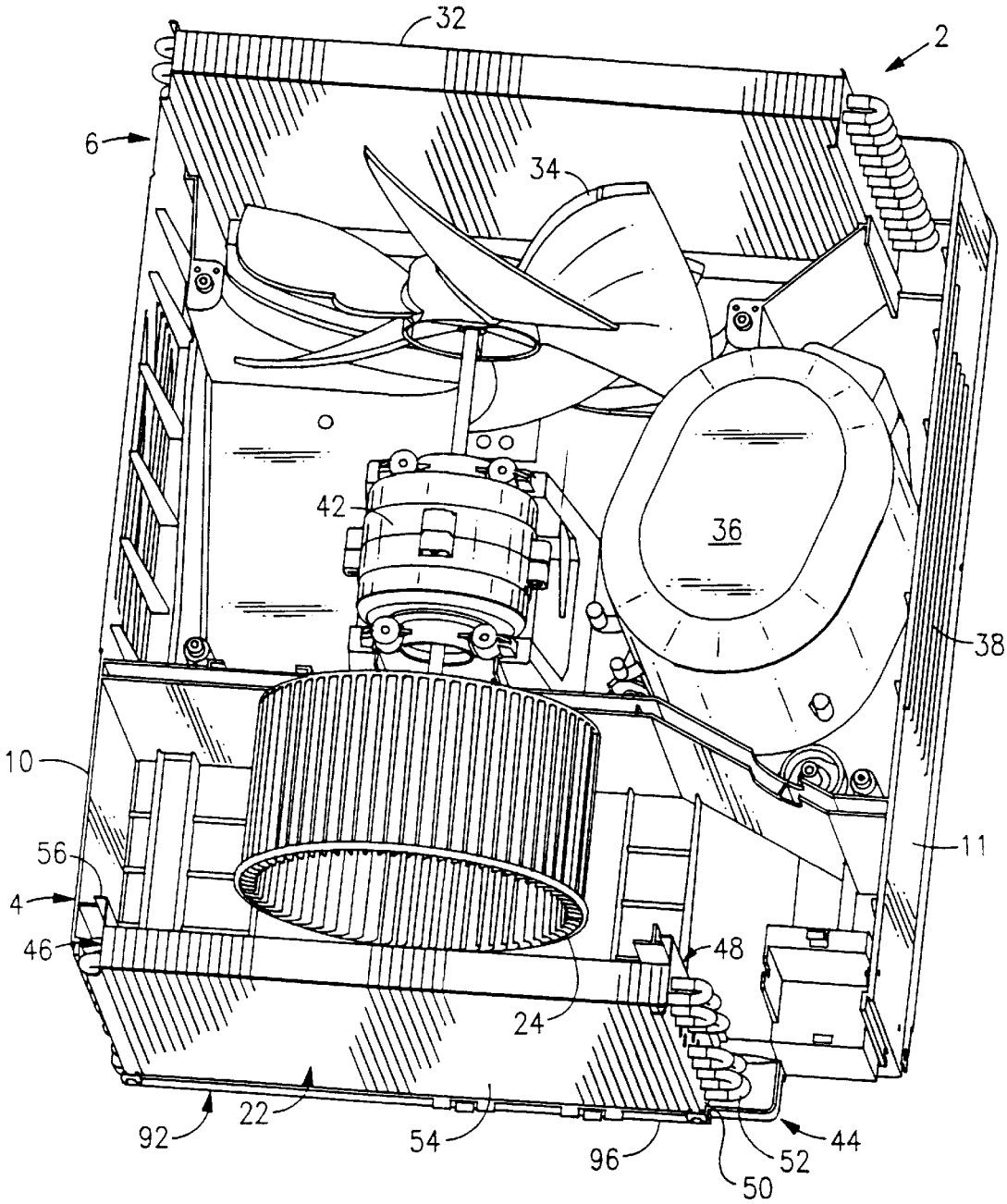
FIG. 2 is a perspective view of the air conditioner of FIG. 1 with the upper cover, front grill portions and other selected components removed therefrom.

FIG. 2 illustrates the unit 2 with the upper housing section 16 and the indoor grill section 18 removed. Again, as is conventional, the unit comprises an indoor refrigerant to air heat exchanger 22 (hereinafter "evaporator coil") and an inside or evaporator fan 24. Air from the space to be conditioned by the system is drawn by action of the evaporator fan 24, through inlet louvers 26 formed in the indoor grill section 18 and is directed through the evaporator coil 22 where the air is cooled. The cooled air is then directed back into the space to be cooled by a scroll assembly 28, which, in turn, directs the air through an indoor conditioned air discharge assembly 30 forming part of the grill 18.

In a fully assembled unit, the evaporator fan 24 is located within the scroll to cause the above-described air flow. The scroll has been removed from several of the drawing Figures in order to clearly show the details of the evaporator coil support of the present invention.

With continued reference to FIG. 2, the unit also includes, as is conventional, an outdoor refrigerant to air heat exchanger or coil 32 (hereinafter "condenser coil 32"), a condenser fan 34 and a compressor 36. In operation, ambient air enters the housing 12 through a number of louvered air inlets 38 located in the top and sides of the housing sections 14 and 16. The air entering the inlets 38 is then drawn through the outdoor fan 34 and is directed through the condenser coil 32 before exiting through discharge openings 40 in the back of the housing 12. As is best seen in FIG. 2, both the evaporator fan 24 and the condenser fan 34 are driven from opposite ends of a single drive shaft of a common drive motor 42 mounted in the outside section 6 of the housing 12.

Figure 3:
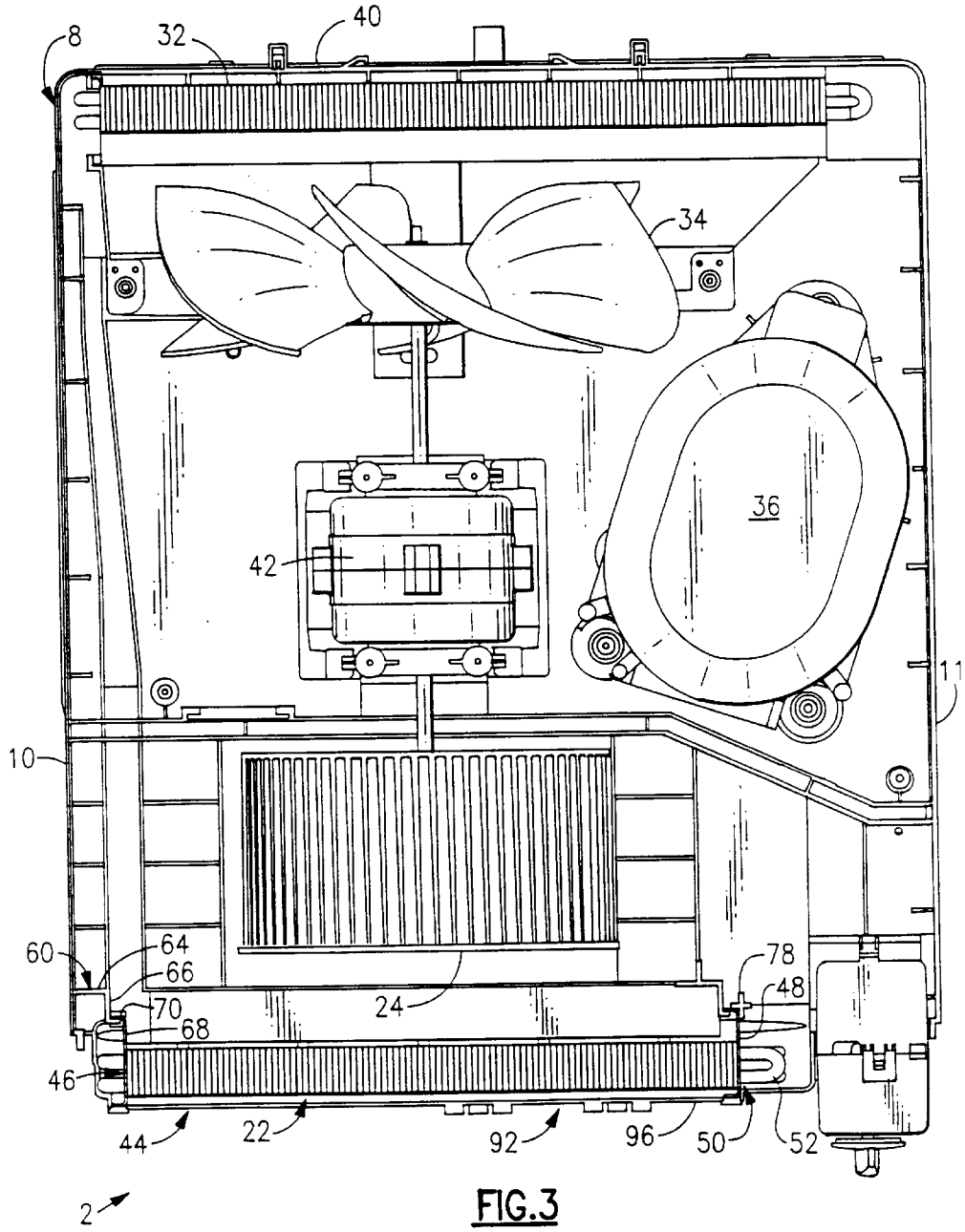
FIG. 3 is a top elevational view of the air conditioner of FIG. 1 with the upper housing and other components removed therefrom.
Figure 3A:
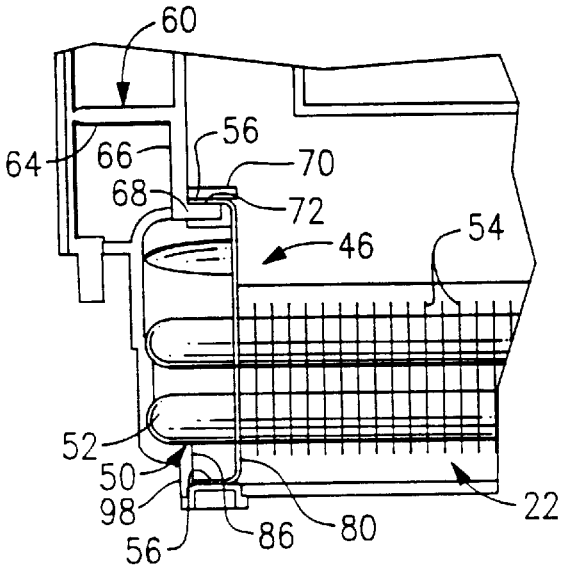
FIG. 3A is an enlarged view of the left front section of FIG. 3.
Figure 3B:
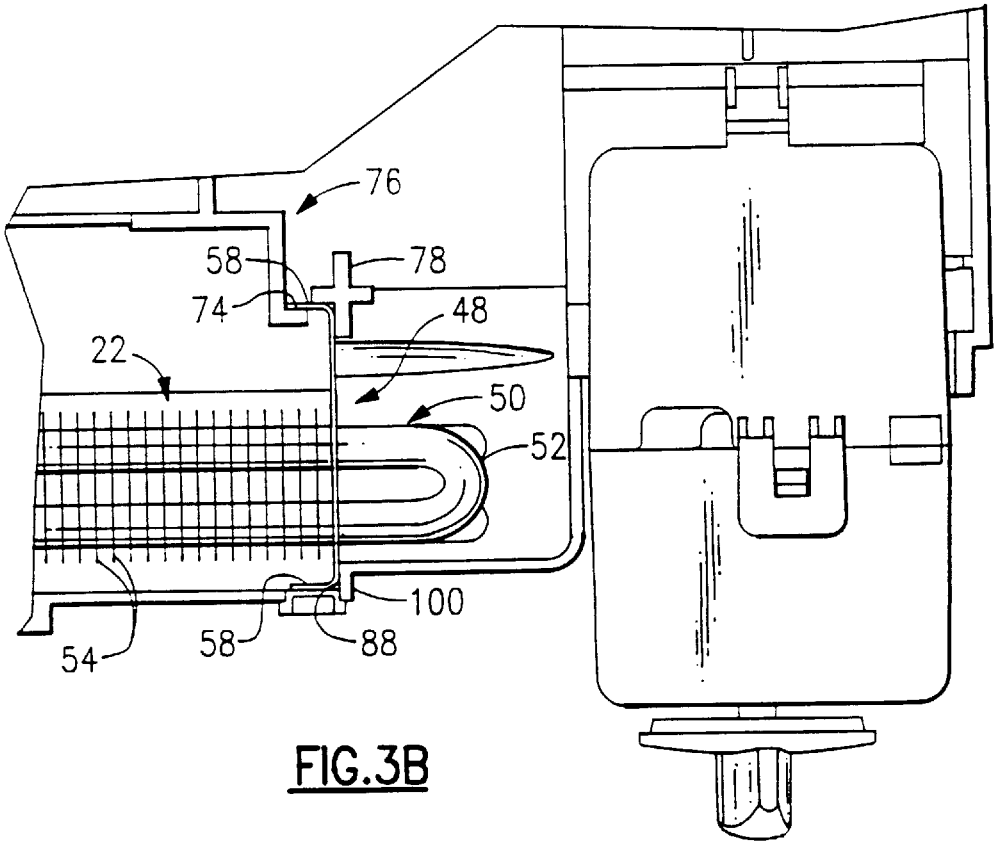
FIG. 3B is an enlarged view of the right front section of FIG. 3.

Looking now at FIGS. 3, 3A and 3B, a top view of the evaporator coil 22, as supported in the front end 44 of the basepan 8 of lower housing section 14 is illustrated. The evaporator coil 22 includes a left-hand tube sheet 46 and a right-hand tube sheet 48. As is conventional, two rows of heat exchanger tubes 50 interconnected by hairpin turn ends 52 extend between the tube sheets to define a continuous flow path for refrigerant therethrough. A plurality of vertically extending heat exchange fins 54 are carried by the tubes and extend substantially vertically and parallel to the tube sheets 46 and 48.

Figure 4:
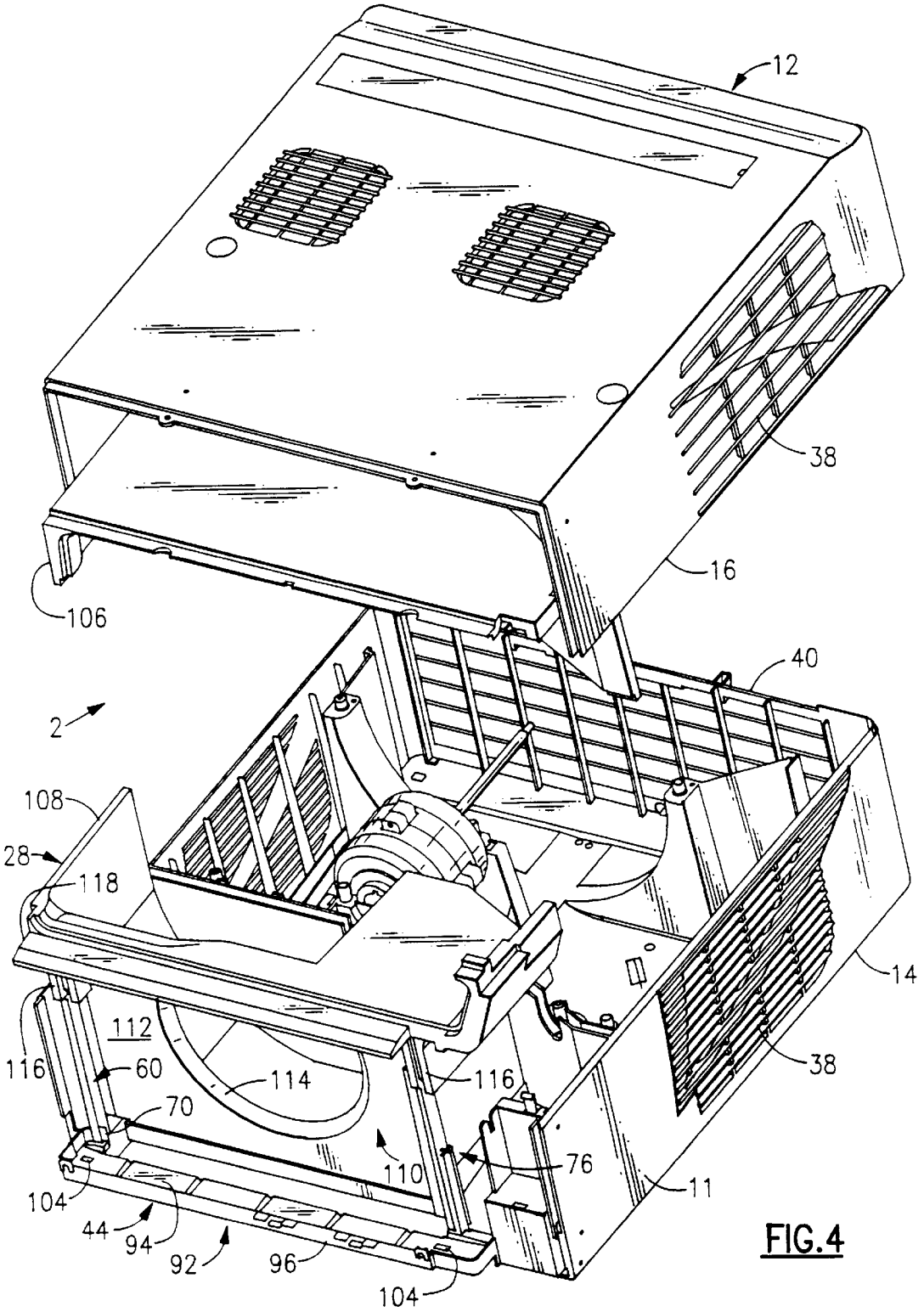
FIG. 4 is a partially exploded perspective view of the air conditioner of FIG. 1 with certain components removed therefrom.
Figure 5:
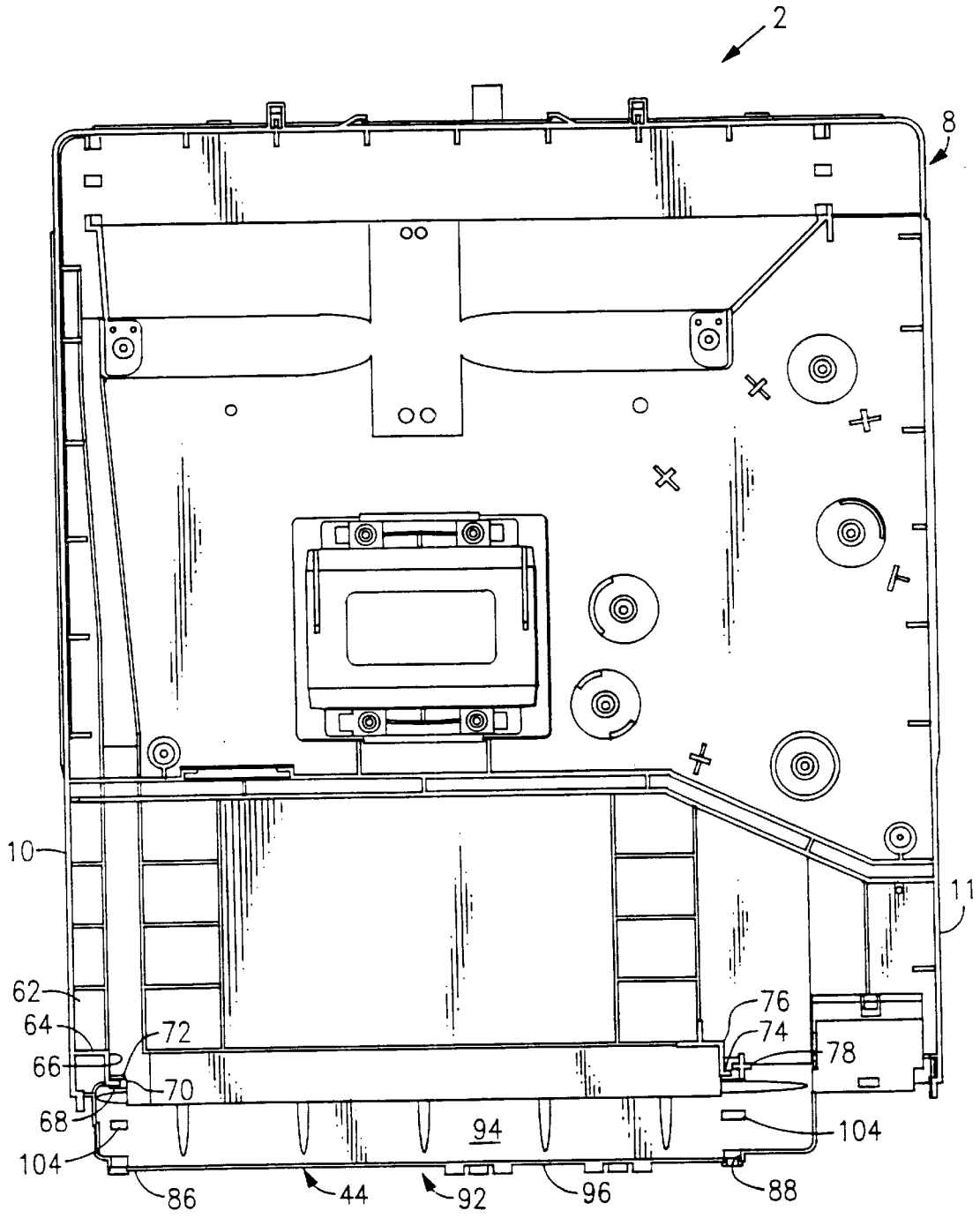
FIG. 5 is a top plan view of the lower housing and basepan of the air conditioner of FIG. 1 with many of the components removed.
Figure 6:
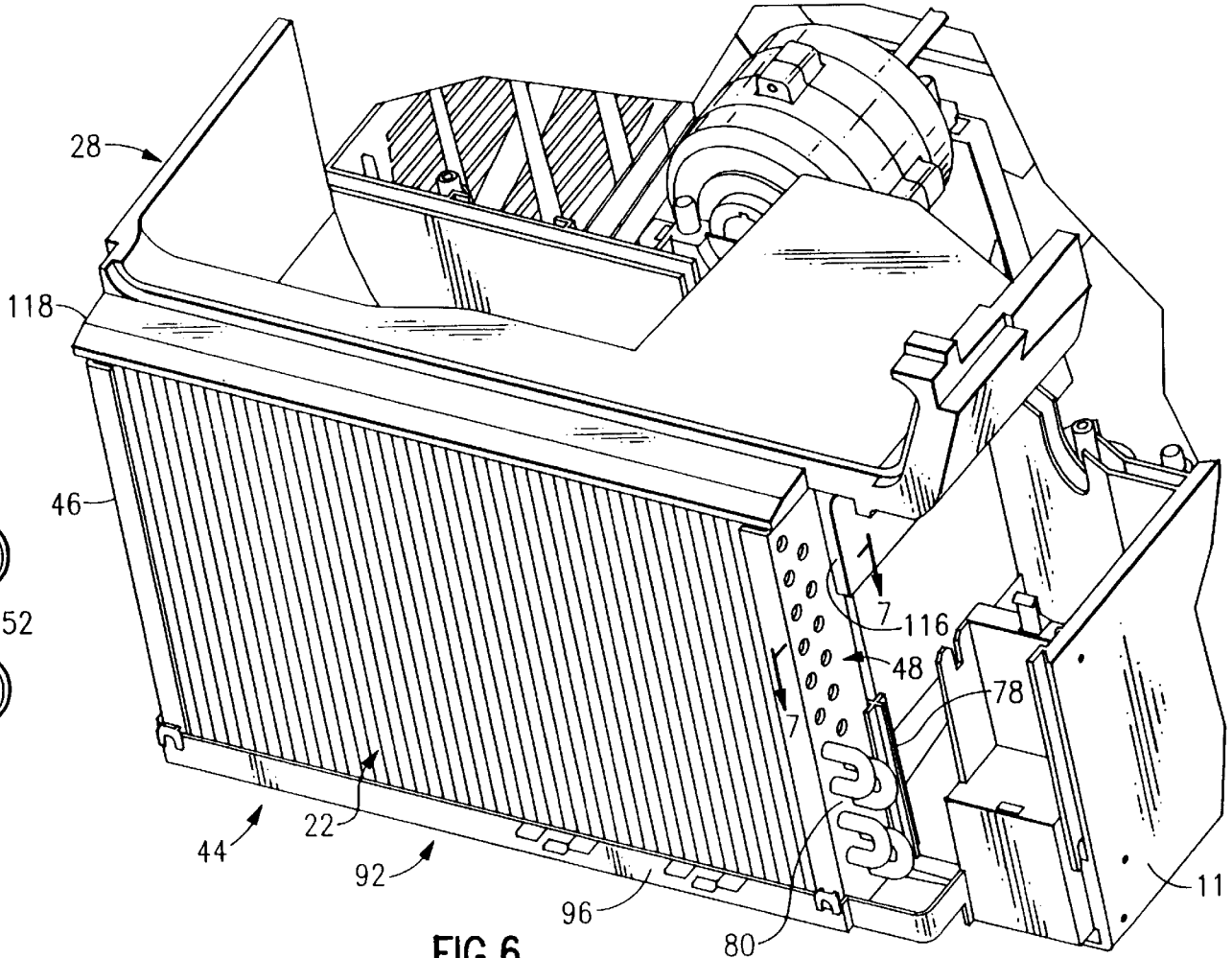
FIG. 6 is a partial perspective view of the air conditioner of FIG. 1.

Support of the evaporator coil 22 will now be described in connection with FIGS. 2 through 6. FIGS. 4, 5 and 6 illustrate the unit with the evaporator coil 22 and many other components removed in order to illustrate the support structure.

Each of the tube sheets 46 and 48 has an elongated U-shaped cross section with short legs 56 and 58, respectively, extending to the left as viewed in the drawing figures. Looking first at the support for the left-hand tube sheet 46 and with particular reference to FIG. 3A, a vertically extending support channel 60 is integrally molded into the basepan and the inside of the left wall 10 of the lower housing section 14. The channel 60 comprises a first section 64 formed integrally with the wall 10 and extending substantially parallel to the evaporator coil 22. A second section 66 extends perpendicular to and forwardly of the first section 64 and a third shorter section 68 extends to the right and substantially parallel to the evaporator coil 22. Extending from the right of the lower end of the second section 66 is a short wall section 70 which is spaced from the third wall section 68 by a distance substantially equal to the thickness of the rear leg 58 of the tube sheet 48. Accordingly, the rear leg 58 of the tube sheet 48 is adapted to engage the rearwardly facing surface 72 of the third channel section 68 and to be received within the space defined between that surface and the short wall section 70.

Looking now at FIG. 3B, the rear leg 58 of the right hand tube sheet 48 is adapted to engage a rearwardly facing surface 74 defined by a vertically extending channel 76 having a cross section substantially identical to that of the channel 60 described in detail for support of the left-hand tube sheet 46. The channel 76 on the right-hand side is molded into the basepan of the lower housing section 14. As with the left-hand tube sheet, the rear leg 58 of the right hand tube sheet is adapted to engage the rear surface 72 of the channel 60. Unlike the left-hand tube sheet, however, support of the right-hand tube sheet is provided in both a lateral and front-to-rear position by a vertically extending substantially cross-shaped section 78, which is adapted to engage both the rearwardly facing surface of the rear leg 58 as well as the right-hand facing wall 80 of the right-hand tube sheet 48.

Further positioning of the evaporator coil 22 is provided by engagement of the front leg 56 of the left-hand tube sheet 46 with a right-hand facing wall 86 molded into the front of the lower housing section 14. In a similar fashion, a left-hand facing wall molded into the front of the lower housing section 14 is adapted to engage the right-hand facing wall 88 of the right-hand tube sheet 48.

As best shown in FIG. 2, the lower ends of the tube sheets 46 and 48 of the evaporator coil 22 are supported by a condensate drain pan 92 formed at the front end of the basepan 8 of the lower housing section 14. The condensate drain pan 92 is defined by a lower horizontal surface 94 which serves to support the lower ends of the tube sheets and a vertically extending perimeter wall section 96. The perimeter wall 96 includes short outwardly extending sections 98 and 100 at the left and right-hand sides thereof and an elongated section 102 which interconnects the short sections 98 and 100. It will be noted that the tube sheet supporting walls 86 and 88 described above are formed in the elongated wall section 102.

As best seen in FIGS. 4 and 5, the horizontal surface 94 of the condensate drain pan 92 is provided with a plurality of small upstanding support pads 104 at both the left and right-hand ends thereof immediately underlying the lower ends of the left and right tube sheets 46 and 48. When the evaporator coil is installed as described above, the lower ends of the tube sheets 46 and 48 engage the pads 104. As a result, the tube sheets and, accordingly, the lower ends of the heat exchange fins 54 of the coil are supported such that they are spaced from the horizontal surface 94.

Figure 7:
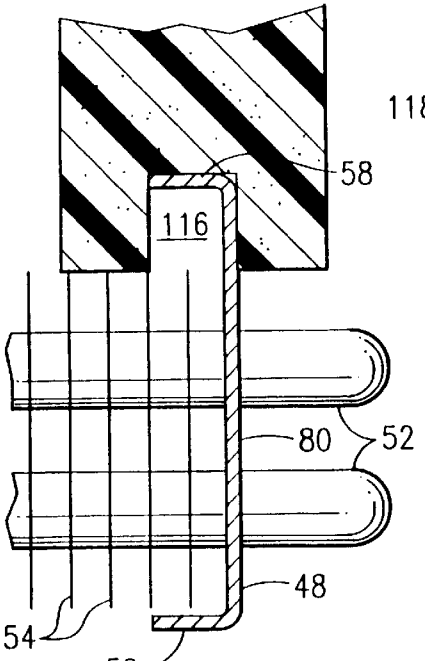
FIG. 7 is a sectional view taken along the line 7—7 of FIG. 6.

With reference now to FIGS. 4, 6 and 7, it will be seen that the air directing scroll 28 comprises an upper and lower section 106 and 108, respectively. Both scroll sections are made from a foamed plastic material. It should be appreciated that from the description above in connection with the indoor fan 24 and the scroll 28, that the fan 24 is adapted to be received within the scroll 28. Accordingly, with reference with FIG. 4, the lower scroll section 108 is shown installed in the air conditioning unit prior to installation of the evaporator fan 24 therein. It will be noted from reference to FIG. 4 that the scroll contains a main body section 110, which extends downwardly behind the evaporator support channels 60 and 76 and comprises a front wall 112 having an opening 114 therein which serves as an inlet to the evaporator fan 24. Positioned on opposite sides of the front wall 112 are a pair of vertically extending evaporator support channels 116. Each of channels 116 is in axial alignment with one of the vertically extending support structure described in detail hereinabove for the left and right-hand tube sheets 46 and 48, respectively. As best seen in FIG. 7, the channels 116 receive the rear leg 58 and a portion of the planar leg of each tube sheet therein.

Also formed integrally with the lower section 108 of the scroll 28 is an evaporator support ledge 118 which extends across the front of the lower section 108 overlying the evaporator support channels 116 and the inlet opening 114. As best seen in FIG. 6, the support ledge 118 engages the upper end of each of the tube sheets 46 and 48 and overlies the entire top portion of the evaporator coil.

Accordingly, it should be appreciated that the evaporator coil is mounted within the indoor section of the housing by simply sliding the left and right-hand tube sheets 46 and 48 into engagement with their respective vertically extending support structures as described above. The thus installed evaporator is then engaged by the lower section 108 of the scroll 28 as described above with the support channels 116 and the support ledge 118 providing additional lateral and vertical support, respectively. Such attachment is carried out without the need for any fasteners.

What is claimed is:

1. An air conditioner of the type having an indoor section which includes a housing, the improvement comprising:

an evaporator coil having a top and vertically extending tube sheets at opposite ends thereof;

a horizontally extending evaporator support surface formed at the front end of said housing for supporting the lower ends of said tube sheets;

first and second vertically extending evaporator support structures, one disposed at each end of said horizontally extending support surface, and each adapted to receive one of said tube sheets therein as said evaporator is displaced downwardly into engagement therewith and towards engagement with said horizontally extending support surface; and a scroll structure for directing air flow within said indoor section, said scroll structure having vertically extending evaporator support channels formed therein in axial alignment with said vertically extending evaporator support structure, said scroll structures being adapted to be engaged with upper ends of said tube sheets following engagement of said evaporator and tube sheets with said vertically extending evaporator support structure.

2. The apparatus of claim 1 wherein said scroll structure further includes a horizontally extending evaporator retaining structure extending between said vertically extending support channel and forwardly thereof, said channels being adapted to engage said top of said evaporator when said vertically extending evaporator support channels of said scroll are in full engagement with said tube sheets.

* * * * *